US009089202B2

(12) United States Patent
Vankov et al.

(10) Patent No.: US 9,089,202 B2
(45) Date of Patent: Jul. 28, 2015

(54) BRUSH HEAD AND METHOD AND TOOL FOR PRODUCING THE SAME

(71) Applicant: Braun GmbH, Kronberg (DE)

(72) Inventors: Michael Vankov, Schmitten (DE); Jochen Kawerau, Kronberg/Taunus (DE); Michael Machlitt, Schwalbach (DE)

(73) Assignee: BRAUN GMBH, Kronberg (DE)

( * ) Notice: Subject to any disclaimer, the term of this patent is extended or adjusted under 35 U.S.C. 154(b) by 0 days.

(21) Appl. No.: 13/911,128

(22) Filed: Jun. 6, 2013

(65) Prior Publication Data

US 2013/0326834 A1 Dec. 12, 2013

(30) Foreign Application Priority Data

Jun. 12, 2012 (EP) ..... 12004427
May 22, 2013 (EP) ..... 13168816

(51) Int. Cl.

| | |
|---|---|
| ***A46B 3/06*** | (2006.01) |
| ***A46B 9/04*** | (2006.01) |
| ***A46D 3/04*** | (2006.01) |
| ***A46D 3/00*** | (2006.01) |

(52) U.S. Cl.

CPC . *A46D 3/045* (2013.01); *A46B 3/06* (2013.01); *A46B 9/04* (2013.01); *A46D 3/005* (2013.01); *A46D 3/04* (2013.01); *A46B 2200/1066* (2013.01)

(58) Field of Classification Search

CPC ..... A46D 3/005; A46D 3/06; A46D 3/045; A46B 3/02; A46B 3/04; A46B 3/06

USPC ..... 15/167.1, 191.1, 192, 193, DIG. 6; 300/21

See application file for complete search history.

(56) References Cited

U.S. PATENT DOCUMENTS 5,622,411 A * 4/1997 Weihrauch ..... 300/21
2009/0056865 A1 3/2009 Kubota et al.

FOREIGN PATENT DOCUMENTS

DE 198 53 030 A1 5/2000
DE 103 42 921 A1 4/2005
DE 10 2005 024 237 A1 11/2006

(Continued)

OTHER PUBLICATIONS

EP1130984B1 (English translation), 2003.*

(Continued)

*Primary Examiner* — Mark Spisich
*Assistant Examiner* — Andrew A Horton
(74) *Attorney, Agent, or Firm* — Vladimir Vitenberg

(57) ABSTRACT

A method for producing a brush head for a toothbrush head is disclosed. The method includes the steps of providing a bristle carrier; providing cleaning elements having first ends which will not be embedded in the bristle carrier and second ends which will be embedded in the bristle carrier, wherein the cleaning elements are selected from at least two different types of cleaning elements or at least two distinctive cleaning elements of the same type; placing the first ends of the cleaning elements in the bristle carrier in a carrier part for holding; and supplying different amounts of heat to the second ends in the bristle carrier by reflecting the heat supplied partially from the carrier part and/or absorbing the heat supplied partially by the carrier part resulting in the second end being molten.

7 Claims, 8 Drawing Sheets

(56) References Cited

FOREIGN PATENT DOCUMENTS

| | | | | |
|---|---|---|---|---|
| DE | 10 2010 025852 | A1 | 3/2012 | |
| EP | 1130984 | B1 * | 4/2003 | ..... A46D 3/04 |
| JP | 10-042954 | A | 2/1998 | |
| JP | 2003 061753 | A | 3/2003 | |
| JP | 2006 116270 | A | 5/2006 | |
| JP | 2006 188041 | A | 7/2006 | |
| WO | WO 97/30611 | A1 | 8/1997 | |

OTHER PUBLICATIONS

European Search Report for EP 12 00 4427, dated Nov. 5, 2012.

* cited by examiner

Fig. 5A
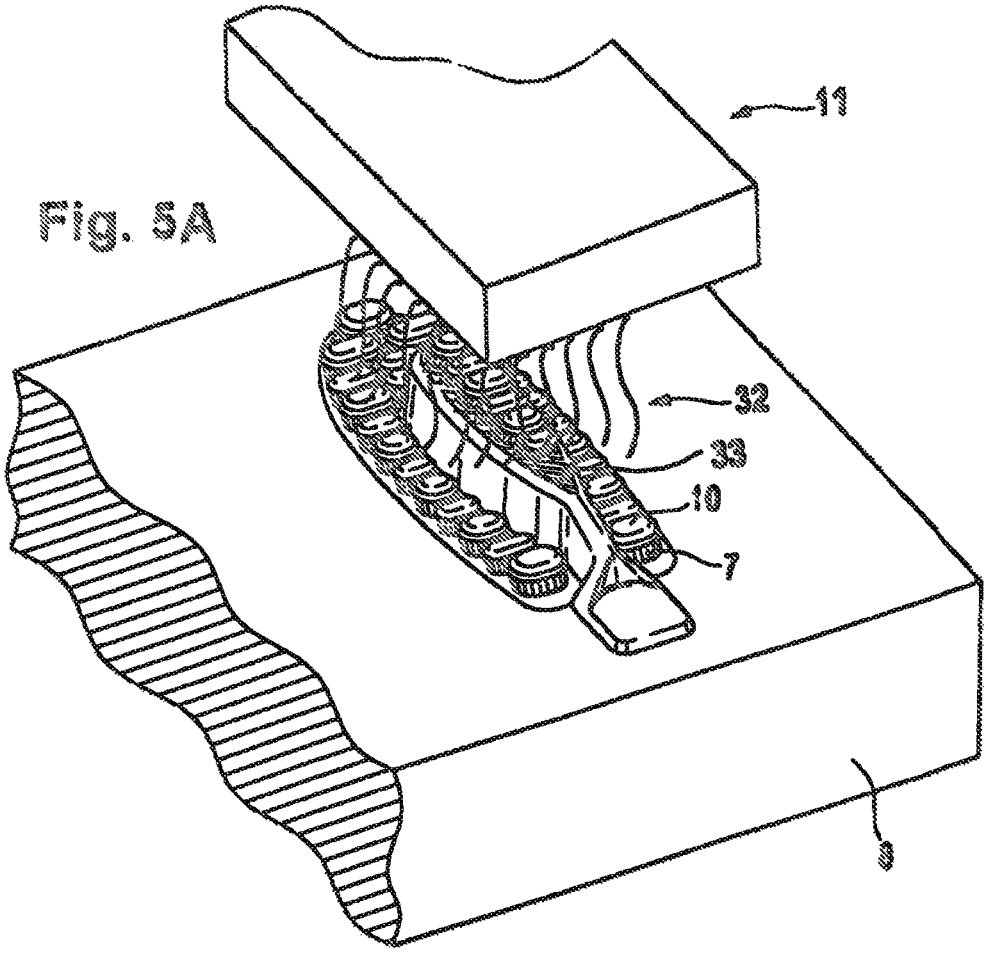
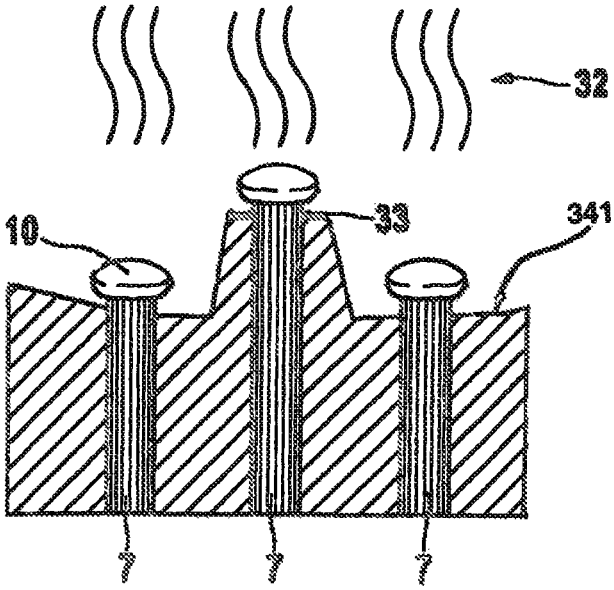
Fig. 5B

BRUSH HEAD AND METHOD AND TOOL FOR PRODUCING THE SAME

REFERENCE TO RELATED APPLICATIONS

This application claims priority to European patent application no. 13168816.0 and European patent application no. 12004427.6, each of which are incorporated herein by reference.

FIELD OF THE INVENTION

The present disclosure is directed to a brush head. More particularly, the present disclosure is directed to a toothbrush head and a method for its production.

BACKGROUND OF THE INVENTION

Anchor and anchor-free methods are known in order to fasten cleaning elements, such as bristle tufts, in a bristle carrier or the brush head of a toothbrush. The anchor-free or hot-tufting methods fasten the cleaning elements in the brush head by means of a forming technique. Usually, the bristle tufts are melted at their ends to form thickenings in order to increase the pull-out resistance of the tufts. These thickenings can be over-molded with a plastic material to form a bristle carrier or a brush head, or the thickenings can be cast in a bristle carrier or a brush head mechanically by other forming techniques.

Theoretically these methods allow to generate bristle fields with different properties in different areas. In order to optimize the cleaning efficiency of toothbrushes, it may be helpful to provide different cleaning elements in different sections of the bristle field or to support cleaning elements or bristle tufts in a different manner, for example, to support a portion thereof rigidly in a section of hard plastic and another portion thereof flexibly in a section of soft plastic. To achieve these results it may be beneficial to melt the ends of differently composed groups of cleaning elements, for example, consisting of different bristle material, to different degrees, in order to achieve an optimum anchoring. However, this is difficult using hot-tufting methods which melt the ends of the tufts after the tufts have been configured into the desired bristle field, because the usually required application of heat to a bristle tuft always also affects adjacent tuft ends. This becomes even more difficult when not only bristle tufts but also differently designed cleaning elements, such as strips of soft plastic, are to be used and to be combined, for example, with bristle tufts.

Accordingly, there is a need for a toothbrush head and manufacturing method thereof, which allows for design flexibility, material flexibility, and support flexibility.

SUMMARY OF THE INVENTION

In one embodiment, a method for producing a brush head for a toothbrush is provided. The method includes the steps of providing a bristle carrier; providing cleaning elements having first ends which will not be embedded in the bristle carrier and second ends which will be embedded in the bristle carrier, wherein the cleaning elements are selected from at least two different types of cleaning elements or at least two distinctive cleaning elements of the same type; placing the first ends of the cleaning elements in the bristle carrier in a carrier part for holding; and supplying different amounts of heat to the second ends in the bristle carrier by reflecting the heat supplied partially from the carrier part and/or absorbing the heat supplied partially by the carrier part resulting in the second end being molten.

These and other features, aspects and advantages of specific embodiments will become evident to those skilled in the art from a reading of the present disclosure.

BRIEF DESCRIPTION OF THE DRAWINGS

The embodiments set forth in the drawings are illustrative in nature and not intended to limit the invention defined by the claims. The following detailed description of the illustrative embodiments can be understood when read in conjunction with the following drawings, where like structure is indicated with like reference numerals and in which:

FIG. 5A is a schematic, perspective illustration of the melting, through application of infrared radiation to the ends of the bristle tufts to be embedded, wherein the infrared radiation device is shown in a working position;

FIG. 5B is an enlarged sectional view of the bristle tuft in the carrier part according to FIG. 5A;

DETAILED DESCRIPTION OF THE INVENTION

Figure 1:
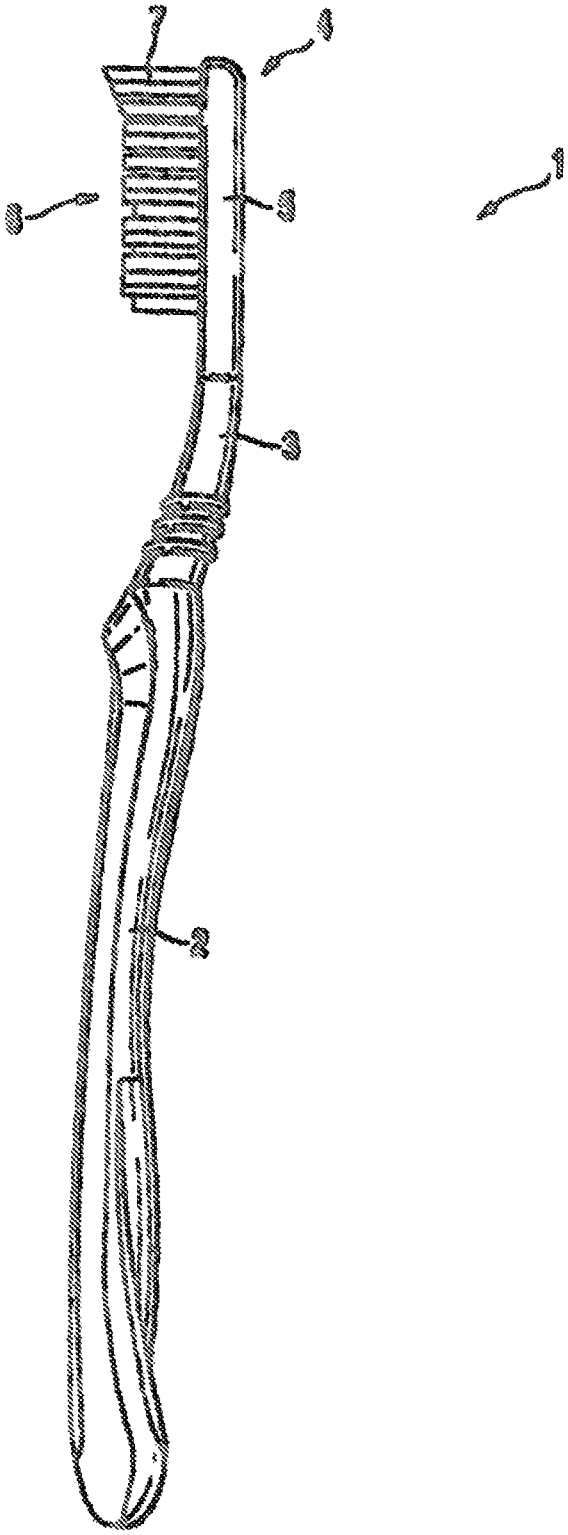
FIG. 1 is a schematic side view of a toothbrush with a bristle field comprising a multiplicity of bristle tufts as cleaning elements which are anchored in an injection-molded bristle carrier in a hot-tufting process one or more embodiments illustrated and described herein.
Figure 2A:
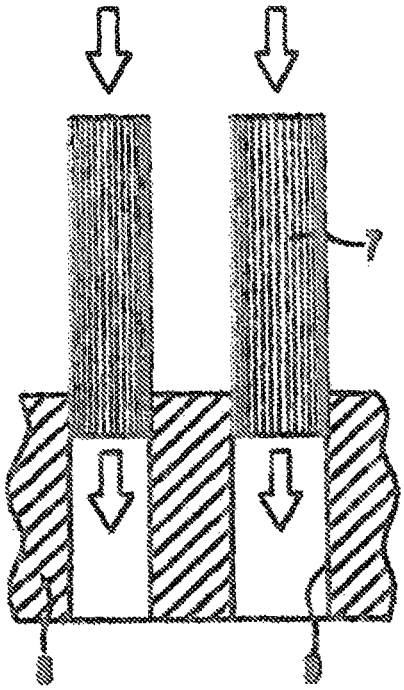
FIGS. 2A, 2B are schematic sectional views of a carrier part for retaining the bristle tufts during the production process; insertion of the bristle tufts into the carrier part is shown in FIG. 2A, and the bristle tufts already in place are shown in FIG. 2B.
Figure 2B:
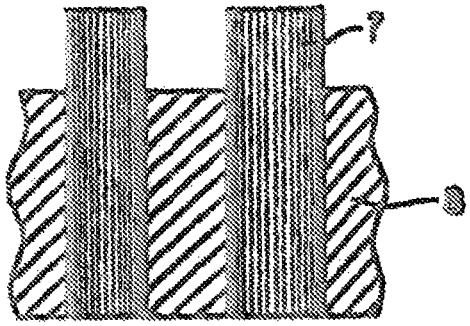

The following text sets forth a broad description of numerous different embodiments of the present disclosure. The description is to be construed as exemplary only and does not describe every possible embodiment since describing every possible embodiment would be impractical, if not impossible. It will be understood that any feature, characteristic, component, composition, ingredient, product, step or methodology described herein can be deleted, combined with or substituted for, in whole or part, any other feature, characteristic, component, composition, ingredient, product, step or methodology described herein. Numerous alternative embodiments could be implemented, using either current technology or technology developed after the filing date of this patent, which would still fall within the scope of the claims. All publications and patents cited herein are incorporated herein by reference.

According to the present disclosure, a brush head and the method for the production thereof is provided. Also disclosed herein is an improved tool for the production of the brush head to allow design flexibility, for example, in the positioning of cleaning elements and allows providing of different types of cleaning elements, including cleaning elements made from differing materials. In one embodiment, an improved brush head may include, for example, a compact form and is efficient to produce, despite the complex design of the bristle field thereof, having, for example, differently designed cleaning elements.

In one embodiment, a method for producing such a brush head, in particular such a toothbrush head is shown, wherein different cleaning elements, in particular bristle tufts, are fused and over-molded at one of their ends using a plastic material. "Different cleaning elements" as used herein shall be understood as two different types of cleaning elements or two distinctive cleaning elements of the same type or a combination thereof. "Different types of cleaning elements" as used herein shall be understood as cleaning elements differing at least in the material they are made from. An example of different types of cleaning elements may be bristles made of different materials or bristles and elastomeric elements. An elastomeric element may be for example, a strip, a nub, a pin, a fin, a wall, a bar, a gutter, a curve, a circle, a lamella, a textured element, a polishing element such as, for example, a polishing cup, a sponge element or a tongue cleaning element or a combination thereof.

Materials which may be used to form elastomeric elements are for example, rubber, polypropylene (PP) or thermoplastic elastomers (TPE) the latter having a Shore A hardness in the range of from about 10 to about 70 or in the range of from about 20 to about 50 or in the range of from about 30 to about 45 or a mixture thereof. "Distinctive cleaning elements of the same type" as used herein shall be understood as cleaning elements which are made of the same material, but which are distinguishable from each other in at least one other property. Examples for these other properties in which the distinctive cleaning elements of the same type may differ are e.g. size, composition, form, outer shape or surface appearance. An example of distinctive cleaning elements of the same type may be bristle tufts having different tuft diameters or having different tuft geometries, or bristles being tapered or crimpled compared to unmodified bristles.

During the manufacturing process the cleaning elements may be held by at least one carrier part which has hole-shaped retaining recesses, in which the cleaning elements may be arranged. In one embodiment, the position of the cleaning elements in the carrier part corresponds to the desired relative arrangement thereof with respect to one another on the brush head. Additionally, the carrier part may form a wall of the mold cavities, in which the ends of the cleaning elements extending out from the carrier part can be over-molded in a multi-component process. Owing to the use of the carrier part as part of the injection mold, the positioning of the ends of the cleaning elements to be over-molded as well as the opening and closing of the injection mold can be executed very simply and efficiently. The side of the carrier part facing the ends to be over-molded may form a negative mold for the cleaning-element-side or bristle-side surface of the bristle carrier of the brush head. The carrier part may be a carrier plate having through holes for holding the cleaning elements or a mold bar having blind holes for holding the cleaning elements.

While the cleaning elements are embedded into the bristle carrier a part of the brush head, the complete brush head or only the bristle carrier itself may be molded. That means the term "bristle carrier" as used herein means the part of a brush, in particular a toothbrush, in which the cleaning elements are mounted or from which the cleaning elements protrude with their free ends. Accordingly, the bristle carrier may be a part of the brush head, a part to be mounted into the brush head or the brush head itself. If the bristle carrier or a part of the brush head are molded the cleaning elements can be transported from a first injection-molding station in which at least said part of a bristle carrier and/or a brush head is injection-molded to a second injection-molding station, in which at least another part of a bristle carrier and/or a brush head is injection-molded. Further steps of transportation to additional injection-molding stations in which additional parts of the bristle-carrier and/or the brush head can be injection-molded are also applicable to the method as described herein. Additionally, the cleaning elements may be located in the at least one carrier part during transportation. Thus, the carrier part, in which the cleaning elements are arranged, may also be used for handling and/or transporting of the cleaning elements in or between the different process steps. For example, the cleaning elements may be transported from the thermal treatment for melting the ends of the cleaning elements to form thickenings to one or more injection molds to form the brush head.

In one embodiment, the thickenings at the cast ends of the cleaning elements are formed in order to increase the pull-out resistance of the cleaning elements from the bristle carrier. The thickenings may be produced by thermal melting of the ends. In one embodiment, the ends which are melted are the ends to be over-molded, i.e. the ends are not the ends used for cleaning the teeth. The ends intended for cleaning the teeth, i.e. the free ends, are located at the opposite end of the cleaning element than the ends intended to be over-molded. Heat may be applied to the cleaning elements, either individually or in groups, thereby reshaping the ends into a thickening. Generally, this can be carried out by means of various types of energy flows in the form of mass flows and/or radiation. For example, the ends to be thickened may be applied to a targeted flow of hot gas or to infrared radiation individually or in groups, in order to be melted thermally.

The corresponding amount of heat may be controlled individually, that is to say independently of one another, for at least two different cleaning elements, in order to achieve an individual melting and/or reshaping of the ends of the at least two different cleaning elements. Therefore the heat applied is reflected and/or absorbed partially and selectively by the carrier part. By reflecting the heat supplied to one of the at least two different cleaning elements a bigger amount of heat impacts on the end of the cleaning element. In addition or alternatively, by absorbing the heat supplied partially, a smaller amount of heat impacts on the end of the cleaning element. This makes it possible to measure out to each of the at least two different cleaning element precisely the amount of heat input that is required in order to produce the desired reshaping.

During the melting process the cleaning elements may be held in a predefined arrangement corresponding to the desired distribution thereof on the brush head. In order to supply different amounts of heat to the different cleaning elements, the heat is absorbed and/or reflected partly by the carrier part. Therefore the carrier part may be coated with a heat-reflective and/or heat-absorbing material. One carrier part may be coated with both heat reflective and heat-absorbing material in order to increase the difference in the amount of heat supplied. Alternatively, only a heat reflective or a heat absorbing coating may be supplied to the carrier part. Thus, the cleaning elements can have varying amounts of heat applied to individually or optionally in groups while they are being held in the manner in which they are intended to be cast in the brush head. This also reduces additional handling measures, such as for example, grip changes or reinsertion of the cleaning elements into different carrier parts.

The amount of heat may be controlled with respect to at least one property in which the at least two different cleaning elements are distinguishable from each other. The property, may be, for example, the material, the color, the composition, the thickness, the outer shape, the softening temperature, the position and/or the distance of the different cleaning elements relative to the heat source, the position relative to the adjacent cleaning element or a combination thereof. For example, a thicker cleaning element and/or one having a higher softening temperature needs a bigger amount of heat to melt than a thinner cleaning element and/or one having a lower softening temperature. In addition or alternatively, a cleaning element being positioned nearer to the heat source needs less impact of heat than one which is positioned farer away from the heat source.

In one embodiment, the reshaping of the ends of the cleaning elements can be carried out solely by applying the heat, for example, infrared radiation, and using the effects of gravity. As a result, the cleaning elements with their ends to be melted are positioned pointing upward, such that a melted end section naturally flows downward, resulting in a mushroom-shaped or drop-shaped thickening. Alternatively or in addition, a punching tool can be used to create the thickening. The punching tool may be driven against the melted ends of the cleaning elements in order to reshape the heated ends accordingly. The punching tool can have various punching surfaces, for example, structured or curved surfaces. The shapes of the punching tool may be adapted in each case to one cleaning element or group of cleaning elements, and which only reshape individually the one cleaning element or one group of cleaning elements, respectively. This makes it possible for a plurality of cleaning elements to be individually reshaped by means of one punching tool having various punching surfaces. Various punching surfaces of the punching tool may be adjustable with respect to one another, in particular to be capable of being positioned in various planes with respect to one another. This makes it possible to create a punching tool pad of different punching surfaces which are positioned raised in relief-like manner at various heights, in order to enable reshaping of the ends of the cleaning elements, which ends are positioned at different heights.

After forming the thickenings at the ends of the at least two different cleaning elements the cleaning elements may be over-molded with a plastic material, thereby forming at least the bristle carrier. Alternatively, the brush head, a part of the brush head or a complete toothbrush is formed during this over-molding step.

In addition or alternatively, a device is described herein for carrying out the method as described above. In one embodiment, the device includes at least a carrier part for holding the free ends which are not intended to be embedded and a heat source for applying heat to the ends to be embedded. The heat source may be, for example, an infrared radiation device. In order to increase the amount of heat supplied selectively, the carrier part in which the different cleaning elements are arranged reflects the heat partially. For example, the carrier part may be coated with, may comprise or may consist of a reflected material. To reflect, for example, infrared radiation the roughness of the carrier part is at least smaller than half of the wavelength of the infrared radiation used. In one embodiment, a suitable reflective material may be polished metal, such as steel, aluminum, silver or a combination thereof.

In order to decrease the amount of heat supplied selectively, the carrier part in which the different cleaning elements are arranged absorbs the heat partially. For example, the carrier part may be coated with, may comprise or may consist of an absorbing material. To absorb, for example infrared radiation, the material of the carrier part should provide an absorption peak in the range of the wavelength of the infrared radiation used. In one embodiment, a suitable absorbing material may be a rough dark surface or a water covered surface. The heat which is absorbed by the carrier part may be dissipated by cooling the carrier part at least selectively.

In addition or alternatively a brush head, for example, a toothbrush head is disclosed having bristle tufts including at least two different cleaning elements being melted individually according to the special requirement of each cleaning element as described above. After forming the thickenings at the ends of the different cleaning elements the ends providing the thickenings are over-molded to form the carrier part or the brush head. If the carrier part is formed by over-molding the carrier part can be embedded into the brush head by fastening it into a recess at the brush head using ultrasonic welding, gluing and/or clipping. All features, whether described in combination or individually and which are described with respect to the method are also applicable to the resulting brush head as far as they have a structural impact to the brush head. That means that the method of production results in structural characteristic features of the brush head.

The toothbrush 1 shown in FIG. 1 comprises a shaft-like handle 2, which is connected to a brush head 4 via a neck piece 3. The brush head 4 comprises a bristle carrier 5 joined to the neck piece 3 which supports a field 6 of cleaning elements 7, which comprises a multiplicity of cleaning elements 7. In the example shown in FIG. 1, the cleaning elements 7 are bristle tufts. Instead of the bristle tufts shown, or in combination with the bristle tufts, other cleaning elements 7 could be provided, for example, in the form of elastomeric elements. In the embodiment shown, the toothbrush 1 is designed as a manual toothbrush; however, a motor-driven toothbrush could also have a correspondingly designed brush head.

If the cleaning element 7 is a bristle tuft 7 each tuft can comprise a multiplicity of bristles that are combined to form the tuft. The bristle tufts are cut to the desired lengths, the free ends of the bristle tufts optionally being tapered, spliced or rounded off as desired. Every treatment to the bristle tufts can be performed on the finished toothbrush 1 or can also be effected before the bristle tufts are mounted to the brush head 4.

FIGS. 2 to 9 show the fusing of the cleaning elements 7 before they are fastened in the bristle carrier 5. The process will be described for bristle tufts as an example of cleaning elements 7. All features described with respect to bristle tufts can be also applied to other cleaning elements 7. According to FIG. 2A, preconfigured, for example cut-to-length bristle tufts 7 are first placed into a carrier part 8 which may form a part of the injection mold for injection molding the bristle carrier 5 or the brush head 4 later on. As shown in FIG. 2A, the carrier part 8 comprises a multiplicity of receptacle recesses 9, which are designed in the form of a through-hole or a blind-hole and which accommodate the corresponding bristle tuft 7 with an accurate fitting. The receptacle recesses 9 may be arranged in a grid pattern that corresponds to the desired positioning of the bristle tufts 7 on the brush head 4. In one embodiment, as shown in FIG. 2B, the bristle tufts 7 protrude by a certain length beyond the carrier part 8, such that the ends of the bristle tufts 7 can be positioned in a mold cavity of an injection mold, in order to be over-molded with plastic therein.

Figure 3:
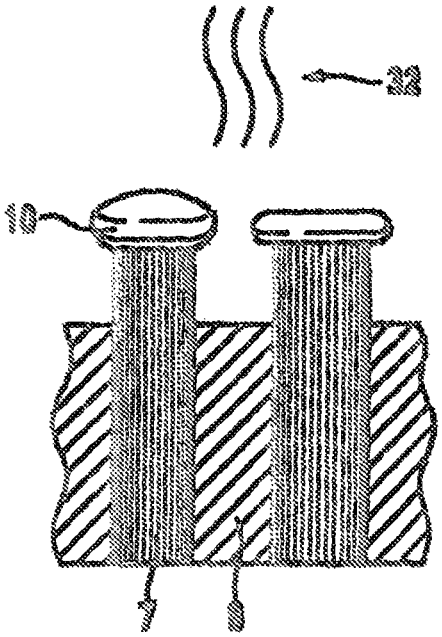
FIG. 3 is a schematic sectional view illustrating the melting and thickening of the ends of the bristle tufts prior to the injection process one or more embodiments illustrated and described herein.

In order to achieve increased resistance of the bristle tufts 7 against being pulled from the bristle carrier 5, the ends of the bristle tufts 7 to be embedded are first reshaped through application of heat energy—for example using infrared radiation 32—in order to form thickenings 10, as shown in FIG. 3.

Figure 4A:
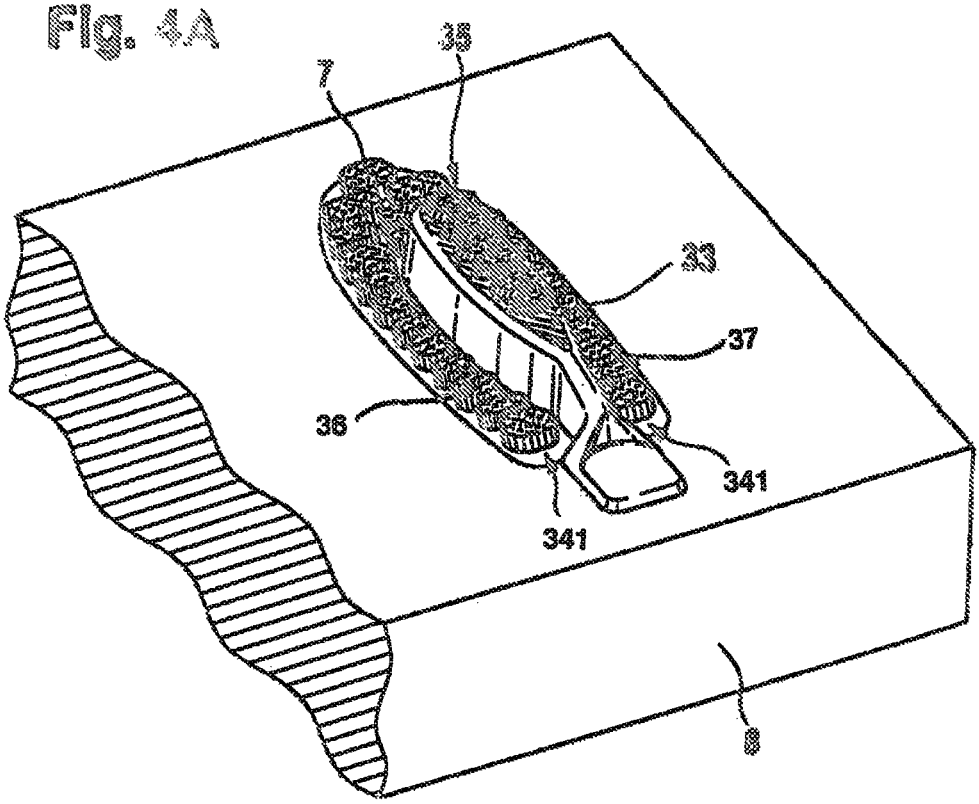
FIG. 4A is a schematic, perspective illustration of the bristle tufts situated in the carrier part, which shows the positioning of the bristle tufts according to one or more embodiments illustrated and described herein.
Figure 4B:
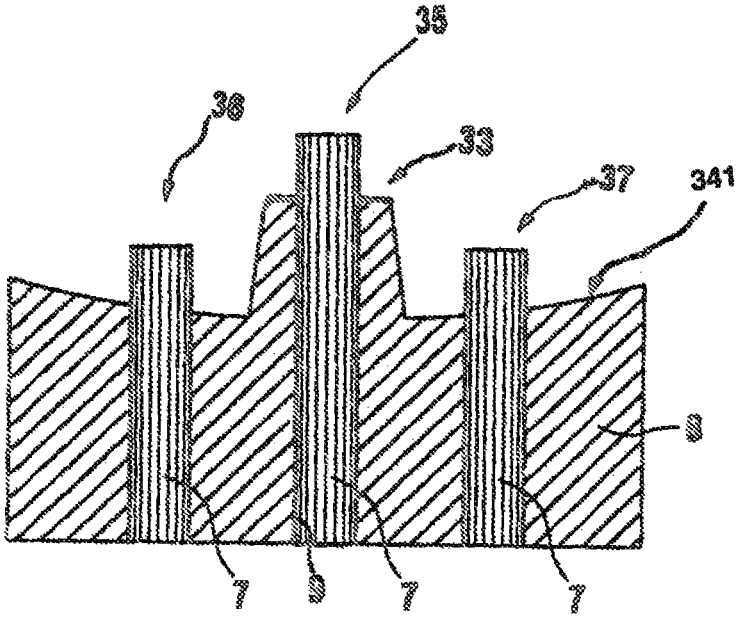
FIG. 4B is an enlarged sectional view of the bristle tuft pattern in the carrier part according to FIG. 4A.

In one embodiment, in order to produce the thickenings 10, the ends of the bristle tufts 7 to be melted protruding from the carrier part 8 are first melted through application of infrared radiation 32. FIGS. 4A and 4B show the initial state, in which the bristle tufts 7 are positioned in the carrier part 8, in the arrangement according to the bristle field 6 to be created. FIG. 4B shows a sectional view of the bristle field 6 before the thickenings 10 are formed at the ends to be melted. According to FIG. 4A, the ends to be melted of the bristle-tufts 7 are arranged in different planes so that the tuft ends to be melted define a three-dimensional arrangement. In the embodiment shown, the ends to be metled of bristle tufts 7 of a center row 35 are positioned higher than the ends to be melted of bristle tufts of rows 36, 37 lying on the outside. If all bristle tufts comprise bristles of an identical length the three-dimensional arrangement of the ends to be melted is identical to the three-dimensional arrangement of the ends of the bristles intended to clean. A three-dimensional arrangement of the ends of the bristle tufts intended to clean might be helpful to improve overall or special cleaning performance. For example inter-dental cleaning performance might be improved by having bristle tuft ends intended to clean which protrude wider from the brush head in the periphery than the bristle tuft ends intended to clean arranged in the center of the brush head. As shown in FIG. 4B, the length of the bristles may also differ between different bristle tufts so that a three-dimensional arrangement of the bristle tuft ends to be melted differs from the three-dimensional arrangement of the bristle tuft ends intended to clean. Thereby, a flat profile of the ends intended to clean may be formed, wherein the length of the bristles tufts differs from each other. This might by used to create different bending strength, although the same kind of bristle is used for several bristle tufts.

In order to still be able to achieve an individually adapted melting despite the three-dimensional arrangement and optional varying cross-sectional surface of the individual bristle tufts 7, the required amount of heat is supplied by absorbing heat in the environment of the center row 35. Therefore, the carrier part 8 is coated with an absorbing material or comprises an absorbing surface 33. The absorbing surface 33 is a rough dark surface. The surface 341 of the rows 36, 37 lying on the outside is made of a less absorbing material like a metal. If now heat 32 is supplied to the bristle tufts 7, for example from an infrared radiation device 11 as shown in FIGS. 5A and 5B equal thickenings 10 can be formed.

As shown in FIG. 5, the ends of the bristle tufts 7 are melted by the application of heat 32 to the extent that drop-shaped thickenings 10 form due to the effects of gravity and surface tension. The bristle tufts 7 are arranged in an essentially vertical orientation with the ends to be melted pointing upwards when the heat. Due to the change of the absorbing properties of the carrier part 8 the melting process works independently from the arrangement of the bristle tuft 7. Thus, equal thickenings 10 can also be achieved using inclined bristle tufts 7.

In FIGS. 6 and 7, different kinds of bristle tufts 7 are shown which are arranged in a common plane. Although the ends of the bristle tufts 7 are arranged at an equal distance to the infrared radiation device 11, different amounts of heat 32 are needed to produce equal thickenings 10. Different cleaning elements, namely bristle tufts 71 and 72, are arranged which differ at least in their tuft diameter from each other. The bristle tuft 72 comprises a thicker diameter than the bristle tuft 71 so that more heat is needed to melt the bristle tuft 72 than to melt the bristle tuft 71.

Figure 6A:
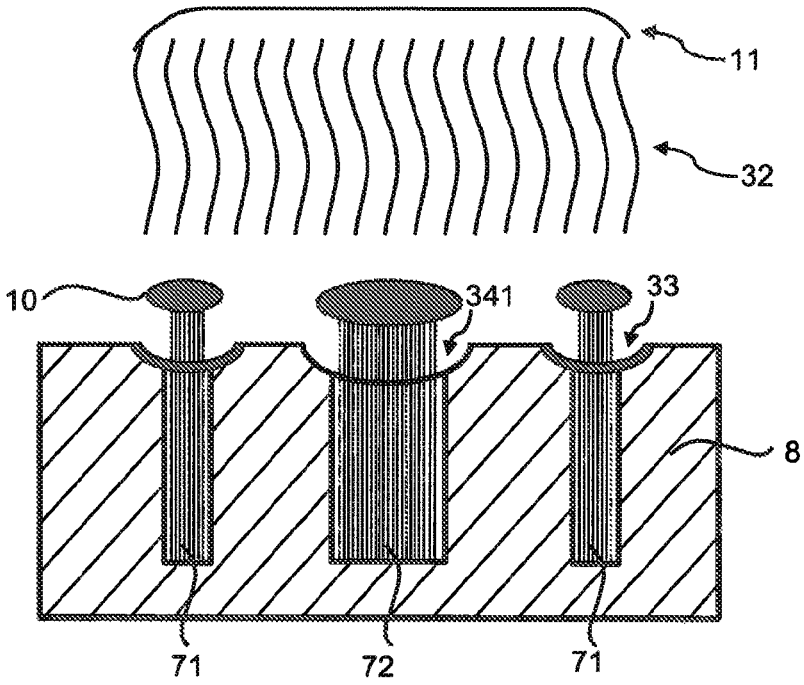
FIG. 6A is a sectional view of the melting, wherein different bristle tufts are positioned in a carrier part having a surface absorbing heat partially according to one or more embodiments illustrated and described herein.
Figure 6B:
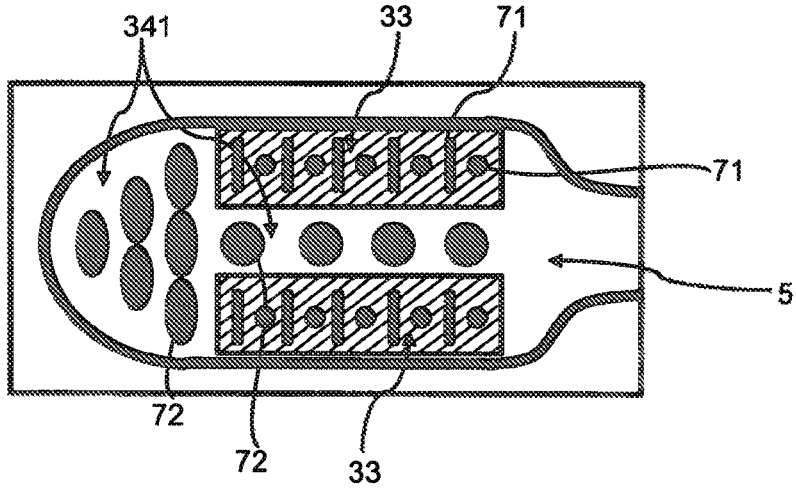
FIG. 6B is a top view to a bristle field being placed in a carrier part having absorbing and less absorbing surfaces according to one or more embodiments illustrated and described herein.

FIG. 6A shows a sectional view of the bristle tufts 71 and 72 being arranged in the carrier part 8. In order to achieve an equal melting of the bristle tufts 71, 72 the environment surrounding the bristle tufts 71 may comprise an absorbing surface 33 and the environment surrounding the bristle tufts 72 may comprise a less absorbing surface 341 compared to the absorbing surface 33. The absorbing surface 33 may be a dark rough surface and the less absorbing surface 341 may be a metal surface. FIG. 6B shows a top view onto the bristle carrier 5. Using the absorbing surface 33, the heat 32 supplied to the bristle tufts 71 is absorbed selectively at the surface 33 and does not show and impact to the ends of the bristle tufts 71. Thus, the heat 32 supplied to bristle tufts 71 is reduced compared to the heat 32 supplied to the bristle tufts 72 which is at least partially reflected at the surface 341. Using the absorbing surfaces 33 selectively at the surface of the carrier part 8, less heat of the heat 32 supplied shows an impact to the ends of the bristle tufts 71 so that an equal melting of bristle tufts 71 and 72 differing at least in their tuft diameter can be achieved and equal thickenings 10 are formed.

Figure 7A:
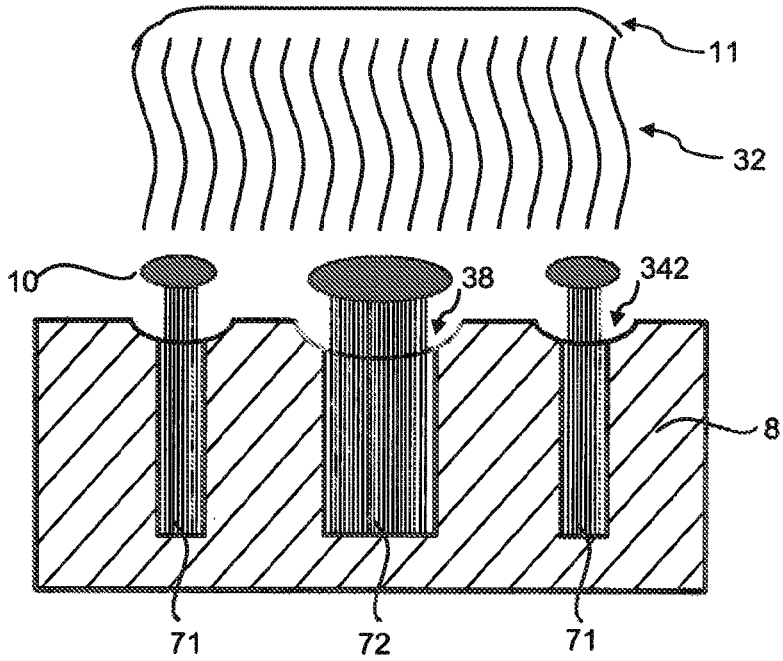
FIG. 7A is a sectional view of the melting, wherein different bristle tufts are positioned in a carrier part having a surface reflecting heat partially according to one or more embodiments illustrated and described herein.
Figure 7B:
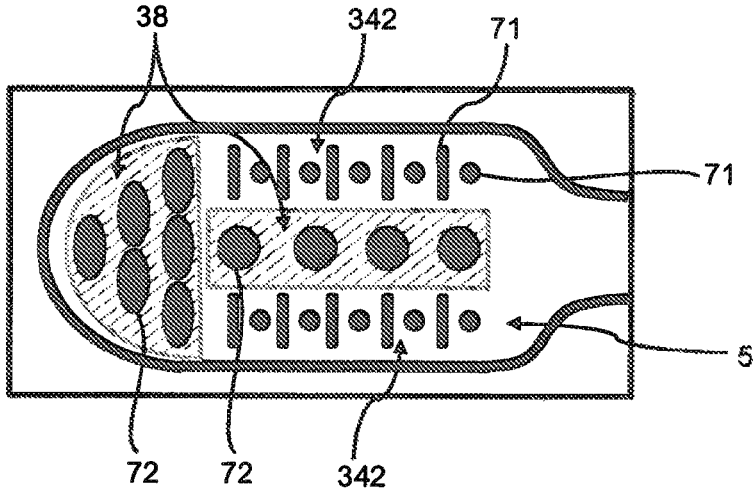
FIG. 7B is a top view to a bristle field being placed in a carrier part having relfecting and less reflecting surfaces according to one or more embodiments illustrated and described herein.

FIG. 7 shows another embodiment of a carrier part 8 which is used to form equal thickenings 10. FIG. 7A shows a sectional view of the bristle tufts 71 and 72 being arranged in the carrier part 8. In order to achieve an equal melting of the bristle tufts 71, 72, the environment surrounding the bristle tufts 72 may comprise a reflecting surface 38 and the environment surrounding the bristle tufts 71 may comprise a less reflecting surface 342 compared to the absorbing surface 38. The reflecting surface 38 may be made of aluminum or a polished metal and the less reflecting surface 342 may be for example a rough metal surface. FIG. 7B shows a top view onto the bristle carrier 5. Using the reflecting surface 38 the heat 32 supplied to the bristle tufts 72 is reflected at the surface 38 and reapplied to the end of the bristle tuft 72. Thus, the heat 32 supplied to bristle tufts 72 is increased compared to the heat 32 supplied to the bristle tufts 71 which is not or at least less reflected at the surface 342. Using reflective surfaces 38 selectively at the surface of the carrier part 8, an equal melting of bristle tufts 71 and 72 differing at least in their tuft diameter can be achieved and equal thickenings 10 are formed.

Figure 8A:
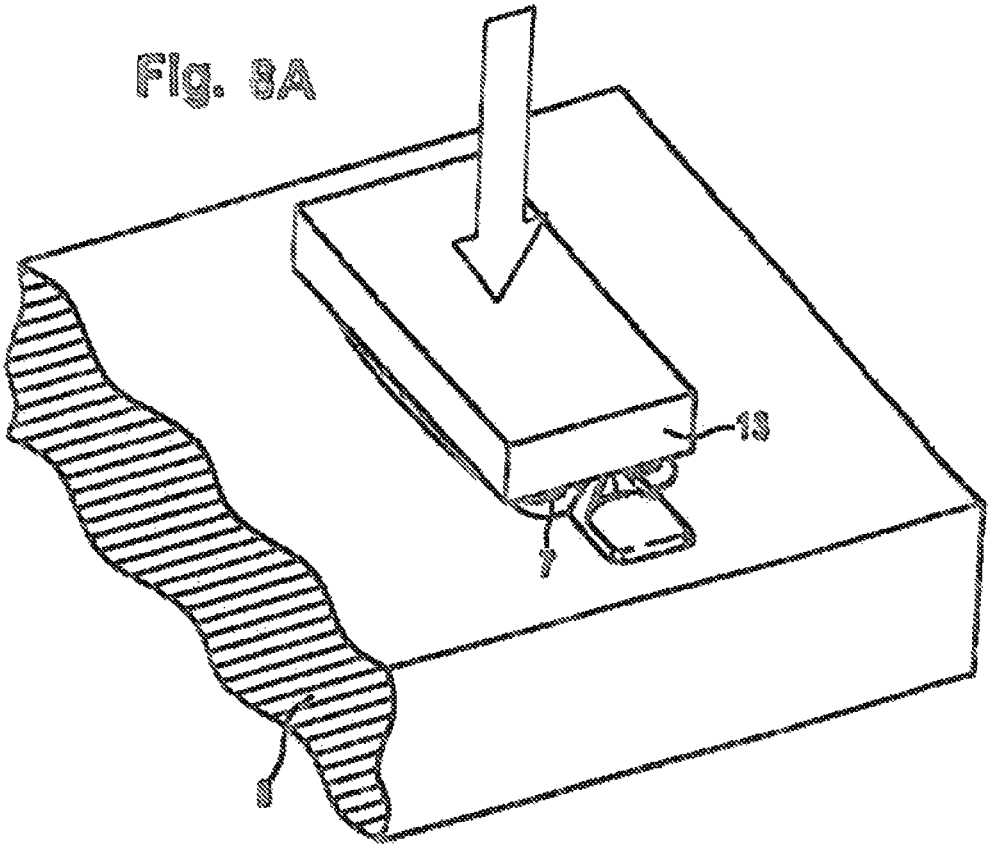
FIG. 8A is a schematic, perspective illustration of the mechanical reshaping by means of a punching tool of the melted end sections of the bristle tufts situated in the carrier part according to one or more embodiments illustrated and described herein.
Figure 8B:
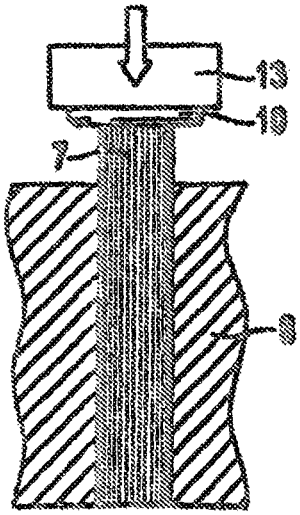
FIG. 8B is an enlarged illustration, of a bristle tuft and the reshaping of the melted end section thereof by means of a section of the punching tool according to one or more embodiments illustrated and described herein.
Figure 9:
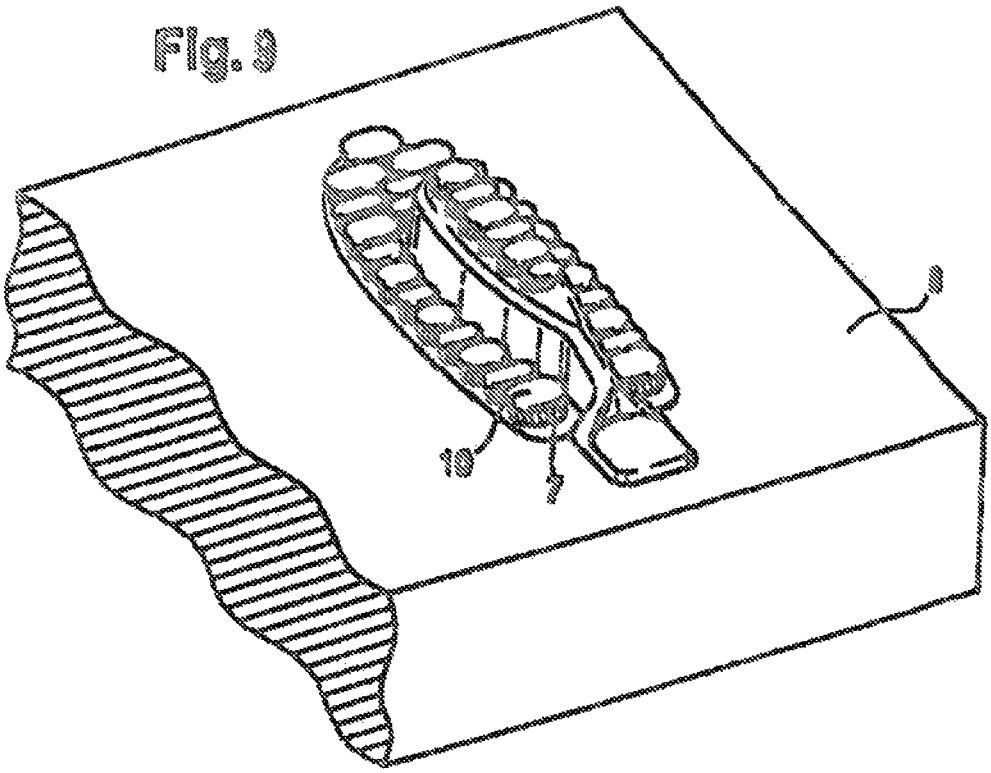
FIG. 9 is a schematic, perspective illustration of the finished reshaped end sections of the bristle tufts situated in the carrier part according to one or more embodiments illustrated and described herein.

As shown in FIGS. 8 and 9, a mechanical reshaping of the melted thickenings 10 can be performed. To this end, a punching tool 13 is used which is moved up against the still-soft, malleable thickenings 10, in order to shape the thickenings 10 in the desired manner. As shown a flat, disk-shaped thickening 10 is generated in such a way that a flat punching tool 13 is pressed on the front side against the ends of the tufts 7. Differently contoured punching surfaces can also be used to generate differently contoured thickenings 10.

In one embodiment, the punching tool 13 may not have a continuous flat punching surface, but rather a multiplicity of punching surfaces, which may be placed in different planes and/or differently contoured, in order to generate the desired thickening 10 individually for each bristle tuft 7 or for one or more adjacent bristle tufts 7. For example, the punching surfaces may be applied to rows and/or special arrangements of bristle tufts 7 in order to generate an identical thickening 10 for several bristle tufts 7. Using the punching tool 13 thin, flat, and/or plate-shaped thickenings 10 can be created as shown in FIG. 9. FIG. 9 shows a three-dimensional arrangement of cleaning elements 7 which all comprise an equal thickening 10, although they are positioned in different plane.

Owing to the different characteristics of the surface of the carrier part 8 a parallel reshaping process of all melted ends of the bristle tufts 7, can be performed, even when the ends of the bristle tufts 7 are positioned in different planes and/or are provided with different geometries and/or consist of various materials.

In one embodiment, after forming the thickenings 10 by means of infrared radiation 32, the ends of the cleaning elements 7 can be anchored by over-molding in a bristle carrier 5; i.e., they can be cast into the bristle carrier 5 during the production thereof. Alternatively, the cleaning elements are cast into the bristle carrier mechanically and the bristle carrier 5 is mounted to the brush head 4.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for producing a brush head for a toothbrush, comprising the steps of:

a) providing a bristle carrier;

b) providing cleaning elements having first ends which will not be embedded in the bristle carrier and second ends which will be embedded in the bristle carrier, wherein the cleaning elements are selected from at least two different types of cleaning elements or at least two distinctive cleaning elements of the same type;

c) placing the first ends of the cleaning elements in a carrier part, wherein the carrier part at least partially forms an injection mold for injection-molding of the bristle carrier, wherein the carrier part comprises at least a first absorbing surface and a second absorbing surface, the first and second absorbing surfaces having different absorbing properties relative to one another; and d) supplying heat to the second ends of the at least two different types of cleaning elements or the second ends of the at least two distinctive cleaning elements of the same type, wherein the heat being supplied reflects from the first and second absorbing surfaces such that the heat reflecting from the first absorbing surface differs from the heat reflecting from the second absorbing surface, and wherein the second ends of the at least two different types of cleaning elements or the second ends of the at least two distinctive cleaning elements of the same type melt substantially equally.

2. The method according to claim 1, wherein the heat is supplied as infrared radiation.

3. The method according to claim 1, wherein the amount of heat supplied to the second ends is adjusted according to at least one property in which the at least two different types of cleaning elements or the at least two distinctive cleaning elements of the same type or a combination thereof are distinguishable from each other.

4. The method according to claim 1, wherein the at least one property in which the at least two different types of cleaning elements or the at least two distinctive cleaning elements of the same type or the combination thereof are distinguishable, is the material, the color, the composition, the thickness, the outer shape, the softening temperature, their position and/or their distance relative to the heat source, their position relative to the adjacent cleaning element or a combination thereof.

5. The method according to claim 1, wherein after applying the heat, a punching tool is moved against the second ends of the at least two different types of cleaning elements or the at least two distinctive cleaning elements of the same type or the combination thereof for reshaping the second molten ends.

6. The method according to claim 1, wherein the at least two different types of cleaning elements or the at least two distinctive cleaning elements of the same type or the combination thereof are embedded into the brush head by over-molding of the second molten ends.

7. The method according to claim 1, wherein a heat-reflective and/or heat-absorbing coating is applied to the carrier part.

* * * * *